US006814880B1

(12) United States Patent
Graf et al.

(10) Patent No.: US 6,814,880 B1
(45) Date of Patent: Nov. 9, 2004

(54) WATER BASED LIQUID FOAM EXTINGUISHING FORMULATION

(75) Inventors: Robert Graf, Antenstadt (DE); Stefan Keipl, Bellenberg (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/257,066

(22) Filed: Feb. 25, 1999

(51) Int. Cl.[7] ..... A62D 1/04; A62D 1/08; A62D 1/00

(52) U.S. Cl. ..... 252/8.5; 252/2; 252/3; 252/7

(58) Field of Search ..... 252/2, 3, 7, 8.05

(56) References Cited

U.S. PATENT DOCUMENTS

| | | | | | |
|---|---|---|---|---|---|
| 4,090,967 | A | * | 5/1978 | Falk | 252/3 |
| 4,203,850 | A | * | 5/1980 | Wirtz et al. | 252/8.05 |
| 4,439,329 | A | * | 3/1984 | Kleiner et al. | 252/8.05 |
| 4,472,286 | A | * | 9/1984 | Falk | 252/3 |
| 4,999,119 | A | * | 3/1991 | Norman et al. | 252/3 |
| 5,053,147 | A | * | 10/1991 | Kaylor | 252/7 |
| 5,085,786 | A | * | 2/1992 | Alm et al. | 252/8.05 |
| 5,091,097 | A | * | 2/1992 | Pennartz | 252/7 |
| 5,207,932 | A | * | 5/1993 | Norman et al. | 252/3 |
| 5,332,524 | A | * | 7/1994 | Kaylor | 252/4 |
| 5,997,758 | A | * | 12/1999 | Barbarin et al. | 252/3 |

FOREIGN PATENT DOCUMENTS

| | | |
|---|---|---|
| DE | 197 08 733 | 3/1997 |
| EP | 0 300 070 | 7/1987 |
| EP | 0 676 220 | 3/1995 |

OTHER PUBLICATIONS

Derwent Patent Abstract (WPAT) No. 95–345941/45 (1995).
Derwent Patent Abstract (WPAT) No. 89–025317/04 (1998).

* cited by examiner

*Primary Examiner*—Joseph D. Anthony
(74) *Attorney, Agent, or Firm*—Aaron R. Ettelman

(57) ABSTRACT

A liquid foam extinguishing formulation comprising a water soluble ammonium salt, a film-forming amphoteric fluorine surfactant, a foam-forming amphoteric co-surfactant, and a frostproofing agent, wherein the formulation is a stable, storable, ready to use, and frostproof single solution.

19 Claims, No Drawings

WATER BASED LIQUID FOAM EXTINGUISHING FORMULATION

BACKGROUND OF THE INVENTION

This invention relates to water-based liquid foam extinguishing formulations. There are three groups of extinguishing formulations. They include the universally usable extinguishing powders which normally contain monoammonium phosphate and ammonium sulfate as their extinguishing agents, which are projected with $CO_2$ as propellent gas. Disadvantages of extinguishing powders are the residues left after the extinguishing process and the emission of dust into the environment.

The second group of extinguishing formulations includes the so-called halons where halogenated hydrocarbons act as extinguishing agents. The halogenated hydrocarbons evaporate completely, but are no longer acceptable on account of the threat they pose to the environment.

The third group comprises extinguishing liquids. This group includes foams based on fluorine surfactants which are also known as lightwater foams or AFFFs (aqueous film-forming foams). Foams such as these are unstable and flowable and spread very quickly over surfaces on which they form a covering film layer. They cover the surface of a burning liquid, for example burning petrol, very quickly. The fluorine surfactants have a very low surface tension (15 to 18 mN/m) and provide the foam with the ability to wet surfaces very thoroughly. However, since they are low foamers and form unstable foams, fluorine surfactants are combined with a co-surfactant in order to obtain a certain degree of foaming and stability of the foam formed. Foams of this type are described in EP 0 300 070 B1 and in EP 0 676 220 A1.

However, fluorine surfactants have the undesirable property that, after dissolution in water, they separate in the event of storage of the extinguishing formulation, thus making it unstable. In order to overcome this problem, therefore, it is known that the extinguishing formulation can be initially introduced in the form of two different components which are only mixed immediately before discharge of the extinguishing formulation from a fire extinguisher. However, this is complicated and requires a special design of the fire extinguisher itself.

The problem addressed by the present invention was to provide a water-based liquid foam extinguishing formulation which would be present in a stable, storable and ready-to-use form. The extinguishing agent would be suitable both for fire class A (glowing solids) and for fire class B (liquid combustible materials and those which become liquid) according to DIN EN 2. In addition, it would be frostproof and both storable and usable over a broad temperature range.

DESCRIPTION OF THE INVENTION

The present invention provides a water-based liquid foam extinguishing formulation in a stable, storable, ready-to-use and frostproof form. The formulation according to the invention contains:

a) at least one water-soluble ammonium salt, b) at least one amphoteric fluorine surfactant as film-forming agent c) at least one amphoteric co-surfactant as foam-former and d) at least one frostproofing agent in the form of a single solution.

The extinguishing formulation according to the invention is stable in storage over a broad temperature range of −20° C. to +60° C. and does not separate, i.e. remains stable. In addition, the extinguishing formulation is chloride-free and does not promote corrosion. In a preferred embodiment, it contains at least two different frostproofing agents in combination with one another.

The simultaneous presence of ammonium salt, frostproofing agent and fluorine surfactant produced problems which had an adverse effect on stability (separation) and on the foaming properties. These problems were solved by using both the fluorine surfactant and the co-surfactant in amphoteric form. Given a combination of at least two frostproofing agents, there is no need for an overly high concentration of frostproofing agent (which promotes precipitation of ammonium salt), even to achieve frost resistance down to −20° C., by virtue of a synergistic effect. The extinguishing formulation according to the invention shows excellent foaming and extinguishing properties. The foaming number is in the range from 5 to 6 l foam/kg extinguishing formulation and, more particularly, of the order of 6 l foam/kg extinguishing liquid. The water half life value of a discharged foam, i.e. the time in minutes in which the foam loses half the liquid originally used, can be adjusted to between 20 and 40 minutes according to the surfactants used and the quantities in which they are used. It is crucial that all the constituents of the extinguishing formulation be present in a single solution and that the solution be storable pending use and remain ready for use in a commercially available hand fire extinguisher (capacity ca. 9 l). The foam may be discharged in the usual way by means of a pressurized gas supply, for example in the form of a $CO_2$ cartridge, provided on the fire extinguisher.

The frostproofing agents are preferably nonionic which has a positive effect on freedom from corrosion. Suitable frostproofing agents are frostproofing agents in the form of organic compounds, more particularly polyhydric alcohols, especially in combination with urea. Suitable combinations are glycol and urea or glycerol and urea, the ratio by weight of polyhydric alcohol to urea preferably being from 4:1 to 8:1 and, more particularly, ca. 6:1. By adding urea as the second frostproofing agent, the quantity of polyhydric alcohol required for frost resistance down to −20° C. can be reduced so that precipitation or crystallization of the ammonium salt can be prevented. Normally, the frostproofing agent contains ca. 20 to 35% by weight and, more particularly ca. 30% by weight of polyhydric alcohol and 3 to 10% by weight and, more particularly, ca. 5% by weight of urea.

The ammonium salts used are normally monoammonium orthophosphate or diammonium orthophosphate. The quantity of ammonium salt is several time higher than the total quantity of surfactant. The quantity by weight of ammonium salt is normally at least 10 times higher and preferably at least 20 times higher than the total quantity by weight of surfactant. Normally, it is about 25 to 30 times higher. The co-surfactant and fluorine surfactant are also present in different quantities with one another. More fluorine surfactant than co-surfactant is required. Thus, the quantity of fluorine surfactant is at least twice as high as and preferably 3 to 4 times higher than the quantity of co-surfactant. Suitable co-surfactants are amphoteric hydrocarbon surfactants which can be divided into ampholytes and betaines, the betaines also including the sulfobetaines. Examples of co-surfactants are alkyl polyglycosides and fatty acid derivatives, such as fatty acid amides, fatty acid imides and, more particularly, fatty acid amidoalkyl betaines. Typical ampholytes are aminocarboxylic acids. Typical betaines are acid amide, acid imide or imidazoline betaines.

Amphoteric fluorine surfactants are analogs of hydrocarbon surfactants in which the H atoms are completely or partly replaced by F atoms. Basically, therefore, it is possible to use the same surfactant products as for the co-surfactants, but in fluorine-substituted form. Suitable examples are polyfluoroalkyl amine oxides and, in particular, polyfluoroalkyl betaines and polyfluoroalkyl sulfobetaines. In addition, it has proved to be favorable to use a combination of at least two different fluorine surfactants of which one shows higher heat resistance than the other. The fluorine surfactant with the higher temperature resistance may be selected in particular from polyfluoroalkyl betaines.

The pH value of the extinguishing formulation according to the invention is mildly acidic and is normally in the range from pH 4.5 to 5. This is due to the slightly acidic properties of the ammonium salts, especially monoammonium and diammonium phosphate.

The quantity of ammonium salt in the extinguishing formulation can be varied within wide limits and is normally between 1 and 30% by weight and, more particularly, between 5 and 15% by weight, based on the total weight of the water-based extinguishing formulation. Relatively small quantities of other constituents, such as thickener, corrosion inhibitor and foam stabilizer, may also be present. However, these constituents are not essential. The use and quantity of a thickener depends on the design of the discharge nozzle of a fire extinguisher. A thickener which may be present in the extinguishing formulation in quantities of 0.01 to 0.2% by weight improves the stability of the extinguishing formulation against separation. A thickener also has a positive effect on the stability of the foam discharged towards organic solvents, such as alcohol and spirit. Suitable thickeners are those based on polysaccharides. The upper limit of ca. 0.2% by weight to the quantity of thickener used arises out of the fact that the foam is still supposed to flow after discharge. Fire extinguishers with nozzles which spray very finely produce rich stable foams even without a thickener so that, in their case, a thickener may be used in very small quantities or omitted altogether.

Suitable corrosion inhibitors are imidazoline derivatives, acetylene glycol derivatives or sodium nitrite. They are generally present in the extinguishing formulation in quantities of 0.01 to 0.5% by weight. A particularly suitable stabilizer is butyl diglycol which may be present in the extinguishing formulation in a quantity of 0.1 to 5.0% by weight.

In one particular embodiment, the extinguishing formulation according to the invention may have the following composition in percentages by weight, based on the total quantity of water-based extinguishing formulation:

- 1% to 30%, more particularly 5% to 15% by weight of ammonium salt;
- 0.05% to 2.0%, more particularly 0.1% to 1.0% by weight of amphoteric fluorine surfactant;
- 0.05% to 1.0%, more particularly 0.1% to 0.5% by weight of amphoteric co-surfactant;
- 15% to 40%, more particularly 25% to 35% by weight of frostproofing agent, more particularly a mixture of agents;
- 0.1% to 5.0%, more particularly 0.1% to 2.5% by weight of foam stabilizer;
- 0.01% to 0.2%, more particularly 0.01% to 0.1% by weight of thickener;
- 0.01% to 0.5%, more particularly 0.1 to 0.5% by weight of corrosion inhibitor; and the balance water. The mixture of frostproofing agents is preferably made up of 70% to 95% by weight of polyhydric alcohol and 30% to 5% by weight of urea.

Further particulars and advantages of the invention will become apparent from the following Examples, which are illustrative of the invention and which do not limit the invention as claimed below.

EXAMPLE 1

35% by weight of tap water are introduced into a stirred vessel and 6% by weight of diammonium phosphate and 6% by weight of urea are dissolved therein while stirring. 20% by weight of glycerol is then added with continuous stirring, a clear solution being obtained as precursor 1 of the product.

In a second stirred vessel, 3.6% by weight of a polyfluoroalkyl betaine in the form of a 25% by weight solution in a mixture of ethanol and water (1:1) are dissolved while stirring in 92.7% by weight of water. 1.4% by weight of a cocofatty acid diethanolamide in the form of a 30% by weight solution in water is then added. Finally, 2.3% by weight of butyl diglycol are added. 33% by weight of this solution are then slowly added with stirring to precursor 1. A clear solution with a foaming value of 6 l/kg and a water half life value of 20 minutes is obtained. The solution is stable. When a commercially available 9 liter fire extinguisher is filled with the solution, Standard Object 27A or 183B according to EN3 can be extinguished with one filling.

EXAMPLE 2

40% by weight of tap water are introduced into a stirred vessel and 4% by weight of monoammonium phosphate and 5.5% by weight of urea are dissolved therein while stirring. 28% by weight of ethylene glycol is then added with continuous stirring, a clear solution being obtained as precursor 1 of the product.

In a second stirred vessel, 4.5% by weight of a polyfluoroalkyl sulfobetaine in the form of a 27% by weight solution in a mixture of ethanol and water (1:1) are dissolved while stirring in 82.5% by weight of water. 1.2% by weight of an alkyl polyglycoside in the form of a 50% by weight aqueous solution and 1.8% by weight of a fatty acid imide dissolved beforehand in water to form a 30% by weight solution are then added. Finally, 4.0% by weight of butyl diglycol and 6.0% by weight of propylene glycol are added. 22.5% by weight of this solution are slowly added with stirring to precursor 1. A clear solution stable at +60° C. to −20° C. is obtained. The solution has a foaming number of 6 l/kg and a water half life of 20 minutes. When a commercially available 9 liter fire extinguisher is filled with this solution, Standard Object 21 A or 233B according to EN3 can be extinguished with one filling.

What is claimed is:

1. A liquid foam extinguishing formulation comprising a water soluble ammonium salt, a film-forming amphoteric fluorine surfactant, a foam-forming amphoteric co-surfactant, and a frostproofing agent, wherein the formulation is a stable, storable, ready to use, and frostproof single solution, and wherein the weight ratio of ammonium salt to amphoteric fluorine surfactant and amphoteric co-surfactant is at least 10:1.

2. A formulation as claimed in claim 1 that is stable from −20° C. to +60° C.

3. A formulation as claimed in claim 2, wherein the frostproofing agent is an organic compound.

4. A formulation as claimed in claim 3, wherein the frostproofing agent is a combination of at least two organic compounds.

5. A formulation as claimed in claim 4, wherein the frostproofing agent comprises a polyhydric alcohol and urea in a ratio by weight of polyhydric alcohol to urea of 4:1 to 8:1.

6. A formulation as claimed in claim 5, wherein the ratio by weight of polyhydric alcohol to urea is about 6:1.

7. A formulation as claimed in claim 1, wherein the weight ratio of amphoteric fluorine surfactant to amphoteric co-surfactant is at least 2:1.

8. A formulation as claimed in claim 7, wherein the weight ratio of amphoteric fluorine surfactant to amphoteric co-surfactant is 3:1 to 4:1.

9. A formulation as claimed in claim 1, wherein the weight ratio of ammonium salt to amphoteric fluorine surfactant and amphoteric co-surfactant is at least 20:1.

10. A formulation as claimed in claim 1, comprising at least two different amphoteric fluorine surfactants, wherein one of said surfactants has higher temperature resistance than another.

11. A formulation as claimed in claim 1 comprising 1% to 30% by weight of ammonium salt.

12. A formulation as claimed in claim 11 comprising 5% to 15% by weight of ammonium salt.

13. A formulation as claimed in claim 1 comprising a thickener.

14. A formulation as claimed in claim 13, wherein the thickener is a polysaccharide-based thickener.

15. A formulation as claimed in claim 1 comprising a corrosion inhibitor.

16. A formulation as claimed in claim 1 comprising a foam stabilizer.

17. A formulation as claimed in claim 16, wherein the foam stabilizer is butyl diglycol.

18. A formulation as claimed in claim 1, said formulation being free of ionic halogen.

19. A formulation as claimed in claim 1 having a foaming number of 5 to 7 l foam/kg formulation.

* * * * *